US011386869B2

(12) United States Patent
Jang et al.

(10) Patent No.: US 11,386,869 B2
(45) Date of Patent: Jul. 12, 2022

(54) DISPLAY DEVICE AND DRIVING METHOD THEREOF ACCORDING TO CAPTURING CONDITIONS OF AN IMAGE

(71) Applicant: LG Display Co., Ltd., Seoul (KR)

(72) Inventors: Junwoo Jang, Paju-si (KR); Heeeun Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/124,894

(22) Filed: Dec. 17, 2020

(65) Prior Publication Data

US 2021/0201850 A1 Jul. 1, 2021

(30) Foreign Application Priority Data

Dec. 31, 2019 (KR) ..... 10-2019-0179727

(51) Int. Cl.
*G09G 5/10* (2006.01)
*G09G 5/02* (2006.01)
*G09G 3/20* (2006.01)

(52) U.S. Cl.
CPC ..... *G09G 5/10* (2013.01); *G09G 3/2003* (2013.01); *G09G 5/026* (2013.01); *G09G 2340/06* (2013.01)

(58) Field of Classification Search
CPC ..... G09G 5/10; G09G 3/2003; G09G 5/026; G09G 2340/06
USPC ..... 345/690
See application file for complete search history.

(56) References Cited

U.S. PATENT DOCUMENTS

| | | | | |
|---|---|---|---|---|
| 9,672,598 | B2 | 6/2017 | Gal | |
| 2006/0208169 | A1* | 9/2006 | Breed | G06K 9/00624 250/221 |
| 2016/0042527 | A1* | 2/2016 | Kim | G06F 16/5854 382/195 |
| 2016/0163027 | A1 | 6/2016 | Gal | |
| 2017/0032732 | A1* | 2/2017 | Lee | H04N 1/6005 |
| 2018/0048845 | A1* | 2/2018 | Kozu | H04N 9/646 |
| 2018/0151104 | A1* | 5/2018 | Heo | G09G 3/2003 |
| 2019/0110031 | A1* | 4/2019 | Toyoda | H04N 9/3194 |
| 2019/0385534 | A1* | 12/2019 | Park | G09G 3/2074 |
| 2020/0219433 | A1* | 7/2020 | Yim | G09G 3/2003 |

FOREIGN PATENT DOCUMENTS

| | | | |
|---|---|---|---|
| KR | 10-2016-0068463 | A | 6/2016 |
| KR | 10-1695027 | B1 | 1/2017 |

* cited by examiner

*Primary Examiner* — Jonathan M Blancha
(74) *Attorney, Agent, or Firm* — Fenwick & West LLP

(57) ABSTRACT

A display device and a driving method thereof are proposed, the display device including an image conversion apparatus receiving a first image signal from the outside and outputting a second image signal by converting a luminance of the received first image signal; a controller generating image data based on the second image signal; a source driver outputting data signals based on the image data; a display panel including a plurality of sub-pixels that emit light based on the data signals; and a memory, wherein the image conversion apparatus generates the second image signal by converting the luminance of the first image signal in such a manner a to satisfy a reference maximum luminance value stored in the memory.

14 Claims, 5 Drawing Sheets

DISPLAY DEVICE AND DRIVING METHOD THEREOF ACCORDING TO CAPTURING CONDITIONS OF AN IMAGE

CROSS REFERENCE TO RELATED APPLICATIONS

The application claims the benefit of Republic of Korea Patent Application No. 10-2019-0179727, filed on Dec. 31, 2019, which is incorporated by reference in its entirety.

BACKGROUND

Field of Technology

The present disclosure relates generally to a display device and, more particularly, to a display device and a driving method thereof.

Description of the Related Art

With the development of information technology, the market for a display device that is a connection medium between a user and information is growing. Accordingly, the use of display devices such as a light emitting display (LED), a quantum dot display (QDD), a liquid crystal display (LCD) is increasing.

Each sub-pixel of the display device may emit light at a luminance corresponding to the data voltage supplied through the data line. The display device may display an image frame by combining lights emitted from pixels including sub-pixels.

Meanwhile, when an image displayed on the display device is captured through a camera, degradation of a quality of the captured image may occur. For example, since the camera capturing conditions may be changed due to lighting at a capturing location or a change in luminance of the displayed image, the image captured through the camera may have moiré artifacts or may include unintended shading.

SUMMARY

An objective of this disclosure is to provide a display device that converts and displays image data according to luminance suitable for capturing conditions, and detects an edge shape of the image data to reduce moiré artifacts.

Another objective of the present disclosure is to provide a method of driving the display device.

However, the objective of the present disclosure is not limited thereto, and may be variously extended without departing from the spirit and scope of the present disclosure.

A display device according to embodiments of the present disclosure includes an image conversion apparatus receiving a first image signal from the outside and outputting a second image signal by converting a luminance of the received first image signal; a controller generating image data based on the second image signal; a source driver outputting data signals based on the image data; a display panel including a plurality of sub-pixels that emit light based on the data signals; and a memory, wherein the image conversion apparatus generates the second image signal by converting the luminance of the first image signal in such a manner a to satisfy a reference maximum luminance value stored in the memory.

An image conversion method according to embodiments of the present disclosure includes calculating a contrast ratio for a first image signal received from the outside; converting a luminance of the first image signal in such a manner as to satisfy a reference maximum luminance value while maintaining the contrast ratio; and generating and outputting a second image signal having the converted luminance, wherein the reference maximum luminance value is determined according to characteristic information of a camera capturing an image displayed according to the second image signal.

A computer program for executing the image conversion method according to embodiments of the present disclosure when executed on a computer may be stored in a computer readable medium.

A display device and a driving method thereof according to the present disclosure converts image data according to maximum luminance suitable for capturing conditions while maintaining a contrast ratio and a color depth, thereby preventing unintended shadows from being included in the image captured by a camera.

In addition, it is possible to detect the edge shape of the image data and thus prevent moiré artifacts from being included in the image captured with a camera by applying a blur mask.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention. In the drawings.

DETAILED DESCRIPTION

Figure 1:
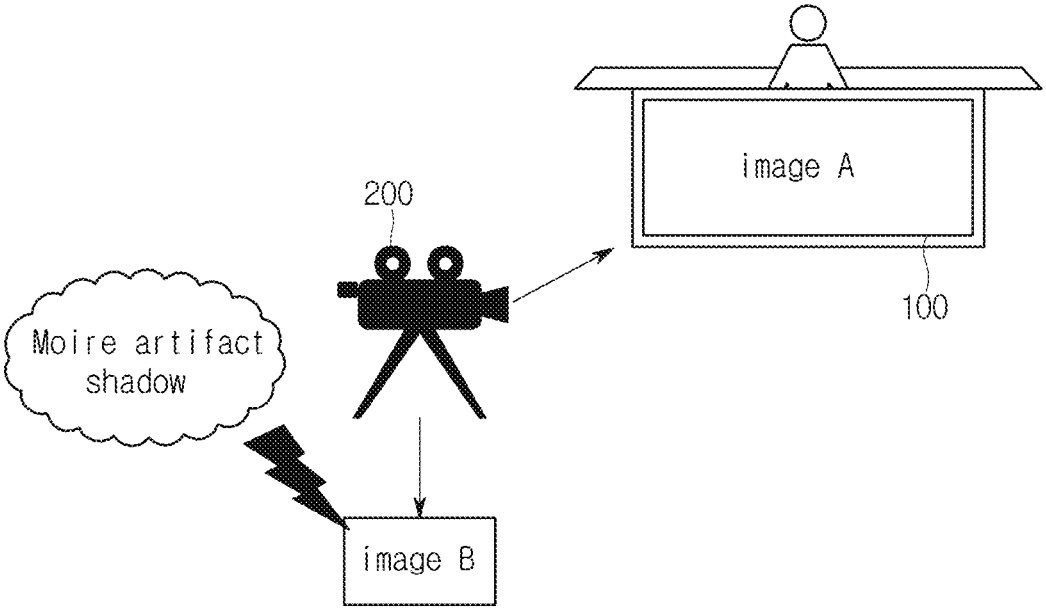
FIG. 1 is a conceptual diagram illustrating capturing conditions according to an embodiment of the present disclosure.

Hereinafter, various embodiments of the present disclosure will be described in detail with reference to the accompanying drawings so that those skilled in the art to which the present disclosure pertains can easily implement them. The present disclosure can be implemented in many different forms and is not limited to the embodiments described herein.

In order to clearly describe the present disclosure, parts irrelevant to the description are omitted, and the same reference numerals are assigned to the same or similar elements throughout the specification. Therefore, the reference numerals described above may be used in other drawings.

In addition, since the size and thickness of each component shown in the drawings are arbitrarily shown for convenience of description, the present disclosure is not necessarily limited to what is illustrated. In the drawings, thickness may be exaggerated in order to clearly express various layers and regions.

FIG. 1 is a conceptual diagram illustrating capturing conditions according to an embodiment of the present disclosure.

The display device 100 receives an image signal from outside of the display device 100 and displays a first image image A according to the received image signal on the screen. Therefore, in general, how clearly a person can recognize the first image image A without any afterimage or blur becomes an important factor.

However, in recent years, the first image image A displayed on the display device 100 is captured with a camera 200, and how clearly a captured second image image B can be recognized has become an important factor. For example, in a broadcast studio, a broadcast video has been produced in such a manner as to synthesize a background on an image captured in a real space using chroma-key technology. However, in recent broadcast studios, the broadcast image is produced in such a manner as to display the first image image A using the display device 100 in a real space and capture the first image image A and the real space together through the camera 200. Therefore, how clearly the second image image B obtained by capturing the first image image A with the camera 200 is recognized without any blur has become an important factor.

Therefore, in order to improve the quality of the second image image B obtained by capturing the first image image A displayed by the display device 100 with the camera 200, a method of converting an image signal input from the outside and displaying the first image image A on the screen using the converted image signal is proposed in the display device 100 according to an embodiment of the present disclosure.

Figure 2:
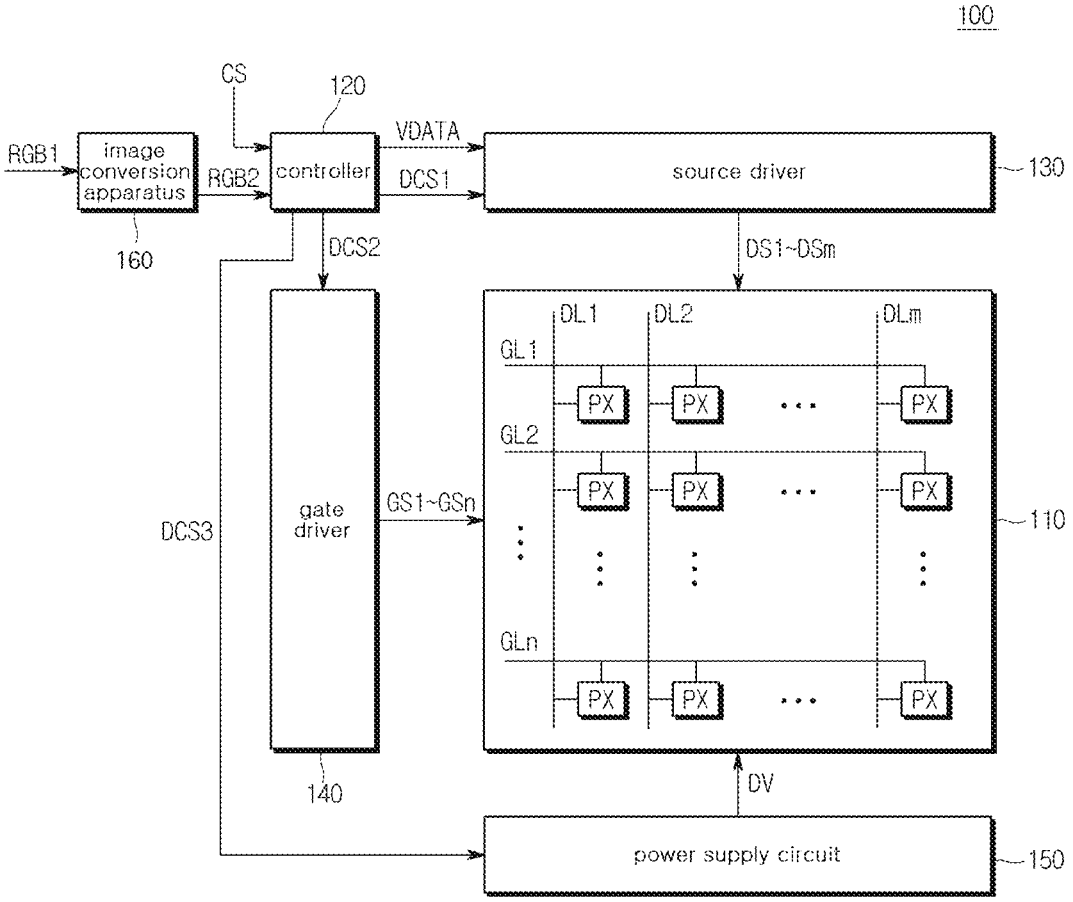
FIG. 2 is an exemplary diagram illustrating a display device according to an embodiment of the present disclosure.

FIG. 2 is an exemplary diagram illustrating a display device according to an embodiment of the present disclosure.

Referring to FIG. 2, a display device 100 includes a display panel 110, a controller 120, a source driver 130, a gate driver 140, a power supply circuit 150, and an image conversion apparatus 160.

The display device 100 may be a device capable of displaying an image or video. For example, the display device 100 means a TV, a smart phone, a tablet personal computer (PC), a mobile phone, a video phone, an e-book reader, a computer, a camera, or a wearable device, but is not limited thereto.

The display panel 110 may include a plurality of subpixels PXs arranged in rows and columns According to embodiments, the plurality of subpixels PXs illustrated in FIG. 2 may be arranged in a lattice structure composed of n rows and m columns (n and m are natural numbers).

For example, the display panel 110 may be implemented as one of a liquid crystal display (LCD), a light emitting diode (LED) display, an organic LED (OLED) display, an active-matrix OLED (AMOLED) display, an electrochromic display (ECD), a digital mirror device (DMD), an actuated mirror device (AMD), a grating light value (GLV), a plasma display panel (PDP), an electro luminescent display (ELD), or a vacuum fluorescent display (VFD), but is not limited thereto.

According to embodiments, the display panel 110 includes n gate lines GL1 to GLn connected in units of rows to subpixels PXs arranged in n rows (n is a natural number equal to or greater than 1) and m data lines DL1 to DLm connected in units of columns to subpixels PXs arranged in m columns (m is a natural equal to or greater than 1). Each of the sub-pixels PX may be connected to one gate line and a data line. For example, the sub-pixel PX disposed in an i-th row (i is a natural number between one and n) and a j-th column (j is a natural number between one and m) may be connected to an i-th gate line and a j-th data line.

According to embodiments, the sub-pixels PX of the display panel 110 may be driven on a per-gate line basis. For example, sub-pixels arranged in one gate line are driven during the first period, and sub-pixels arranged on the other one gate line may be driven during the second period after the first period. Herein, a unit time period in which the subpixels PX are driven may be referred to as one horizontal period (1H).

The subpixels PXs may include a light emitting element configured to output light and a light emitting element driving circuit driving the light emitting element. The light emitting element driving circuit is connected to one gate line and one data line, and the light emitting element may be connected between the light emitting element driving circuit and a power supply voltage (e.g., ground voltage).

According to embodiments, the light emitting element may include a light emitting diode (LED), an organic light emitting diode (OLED), a quantum dot LED (QLED), or a micro light emitting diode (micro LED), but not limited thereto.

Each of the sub-pixels PXs may be one of a red element R outputting red light, a green element G outputting green light, a blue element B outputting blue light, and a white element W outputting white light, and the red element, the green element, the blue element, and the white element may be arranged in the display panel 110 according to various ways.

The light emitting element driving circuit may include a switching device connected to the gate lines GL1 to GLn, for example, a thin film transistor (TFT). When a gate-on signal is applied from the gate lines GL1 to GLn to allow the switching element to be turned on, the light emitting element driving circuit may supply data signals received from the data lines DL1 to DLm connected to the light emitting element driving circuit to the light emitting element. The light emitting element may output light corresponding to the image signal.

The image conversion apparatus 160 receives the first image signal RGB1 from the outside, and generates a second image signal RGB2 by converting the first image signal RGB1 in such a manner as to remove unintended shadows or moiré artifacts captured by the camera 200 when the first image signal RGB1 is displayed, and transmits the generated second image signal RGB2 to the controller 120.

Figure 3:
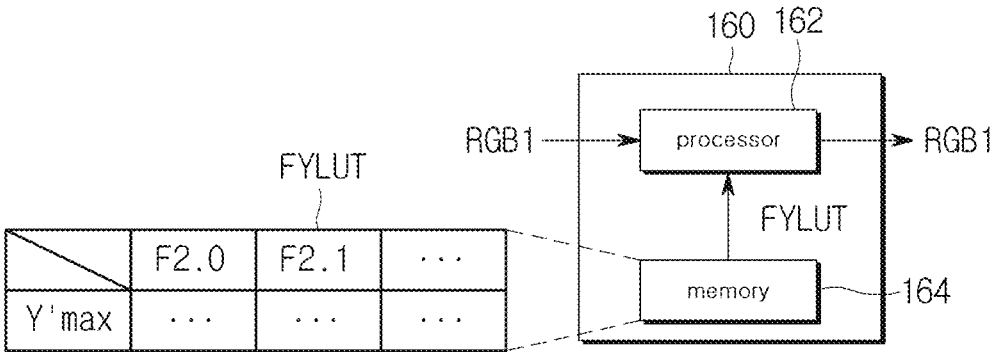
FIG. 3 is an exemplary diagram illustrating an image conversion apparatus according to FIG. 2 according to an embodiment of the present disclosure.

Specifically, the image conversion apparatus 160 generates the second image signal RGB2 by converting the luminance of the first image signal RGB1 in such a manner as to satisfy a reference maximum luminance value by referring to a look-up table FYLUT (see FIG. 3). Therefore, the image conversion apparatus 160 generates the second image signal RGB2 by converting the luminance of the first image signal RGB1, to allow an image to be displayed according to the second image signal RGB2 having a luminance corresponding to the capturing conditions (for example, characteristic information of the camera 200) and to reduce unnecessary shadows from being included in the image captured by the camera 200.

In addition, the image conversion apparatus 160 may convert the first image signal RGB1 into a gray scale signal and detect an edge from the gray scale signal. Here, when the edge is detected, the image conversion apparatus 160 may apply a blur mask to the first image signal RGB1. Accordingly, the image conversion apparatus 160 applies the blur mask to the first image signal RGB1 to relieve the edge of the first image signal RGB1, thereby preventing moiré artifacts capable of being admitted by the camera 200.

The first image signal RGB1 and the second image signal RGB2 may be image signals according to an RGB (red, green, and blue) format or a color system.

The controller 120 may receive the second image signal RGB2 from the image conversion apparatus 160 and generate the image data VDATA on the basis of second image signal RGB2. The controller 120 may transmit the image data VDATA to the source driver 130.

The controller 120 may receive a control signal CS from an external host device. The control signal CS may include a horizontal synchronization signal, a vertical synchronization signal, and a clock signal, but is not limited thereto.

The controller 120 may generate a first driving control signal DCS1 for controlling the source driver 130 on the basis of the received control signal CS, and a second driving control signal DCS2 for controlling the gate driver 140, and a third driving control signal DCS3 for controlling a power supply circuit 150.

The controller 120 may transmit the first driving control signal DCS1 to the source driver 130, transmit the second driving control signal DCS2 to the gate driver 140, and transmit the third driving control signal DCS3 to the power supply circuit 150.

The source driver 130 generates data signals DS1 to DSm corresponding to the image displayed on the display panel 110 on the basis of the image data VDATA and the first driving control signal DCS1, and transmits the generated data signals DS1 to DSm to the display panel 110. The data signals DS1 to DSm may be transmitted to each of the subpixels PXs, and the sub-pixels may emit light on the basis of the received data signals DS1 to DSm. For example, the source driver 130 may provide the data signals DS1 to DSm to be displayed in a 1H period to subpixels PXs driven in the 1H period through the data lines DL1 to DLm for the 1H period.

The gate driver 140 may sequentially provide the gate signals GS1 to GSn to the plurality of gate lines GL1 to GLn in response to the second driving control signal DCS2. The respective gate signals GS1 to GSn are signals for turning on the subpixels PX connected to the respective gate lines GL1 to GLn, and may be connected to a gate terminal of a transistor included in the respective subpixels PXs.

The power supply circuit 150 may generate a driving voltage DV to be provided to the display panel 110 on the basis of the third driving control signal DCS3, and transmit the generated driving voltage DV to the display panel 110. The driving voltage DV may include a low potential driving voltage and a high potential driving voltage having a potential higher than the low potential driving voltage. According to embodiments, the power supply circuit 150 may transmit each of the low potential driving voltage and the high potential driving voltage to each of the subpixels PX through separate power lines.

In this disclosure, the source driver 130 and the gate driver 140 may be referred to as a panel driving circuit.

According to embodiments, at least two of the controller 120, the source driver 130, and the gate driver 140 may be implemented as one integrated circuit. In addition, according to embodiments, the source driver 130 or the gate driver 140 may be implemented in such a manner as to be mounted on the display panel 110. In addition, according to embodiments, the power circuit 150 may be located outside the display panel 110.

FIG. 3 is an exemplary diagram illustrating an image conversion apparatus according to FIG. 2.

Referring to FIG. 3, the image conversion apparatus 160 may include a processor 162 and a memory 164.

The processor 162 may be a circuit having an operation processing function. For example, the processor 162 may be a central processing unit (CPU), a micro controller unit (MCU), a graphic processing unit (GPU), or an application specific integrated circuit (ASIC), but is not limited thereto.

The memory 164 may store a lookup table FYLUT defining a reference maximum luminance value Y'max in advance. Here, the reference maximum luminance value Y'max means the maximum luminance value that enables stable image capturing of the camera 200 according to characteristic information of the camera 200 capturing the image displayed on the display device 100.

Herein, the characteristic information of the camera 200 may include an aperture value (F number, F2.0, F2.1, etc. in FIG. 3) of the camera 200, and therefore, the look-up table FYLUT may define a matching relationship between the aperture value of the camera 200 and a reference maximum luminance value Y'max.

The image conversion apparatus 160 generates the second image signal RGB2 by converting the luminance of the first image signal RGB1 in such a manner as to satisfy the reference maximum luminance value Y'max indicated by the lookup table FYLUT. Here, the camera 200 may be varied according to capturing conditions, and thus is not limited to a specific camera.

According to embodiments, the camera 200 may transmit characteristic information of the camera 200 to the display device 100 through a wired or wireless network, and the image conversion apparatus 160 may retrieve the reference maximum luminance value Y'max corresponding to the characteristic information received from the look-up table FYLUT using characteristic information of the camera 200 transmitted from the camera 200.

In addition, the memory 164 may further store instructions, and the processor 162 may perform at least one step by the instructions stored in the memory 164.

According to an embodiment, the image conversion apparatus 160 may be implemented as one integrated circuit (IC), but is not limited thereto. The image conversion apparatus 160 may be integrated into the controller 120 and included in the controller 120.

The operation of the image conversion apparatus 160 described below may be an operation performed by the processor 162 or an operation indicated by instructions. In addition, the operation of the image conversion apparatus 160 described below may be referred to as a driving method of the display device 100 according to FIG. 1.

Figure 4:
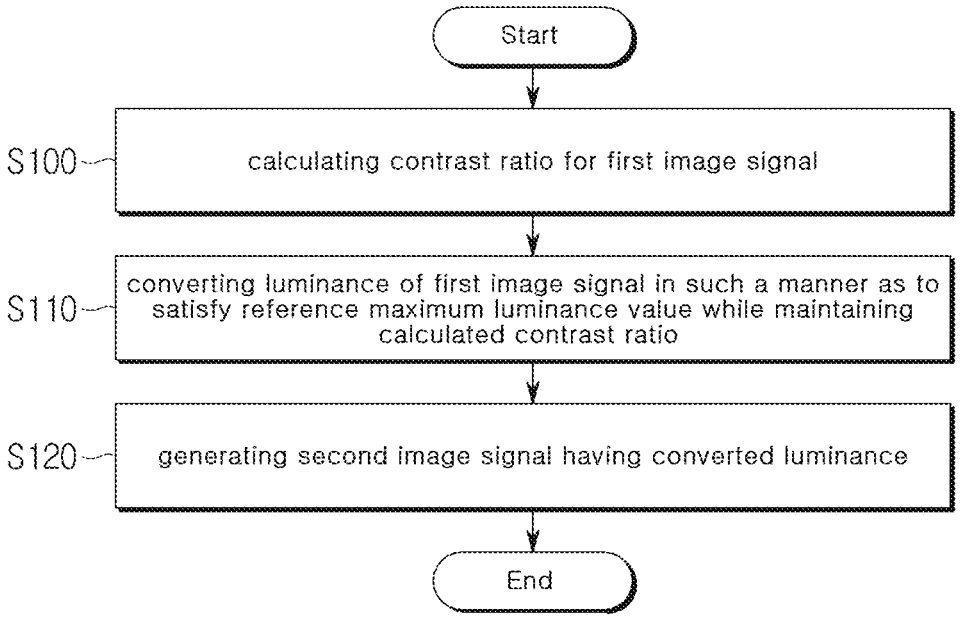
FIG. 4 is a flowchart illustrating a process of generating a second image signal in an image conversion apparatus according to FIG. 2 in accordance with an embodiment of the present disclosure.

FIG. 4 is a flowchart illustrating a process of generating a second image signal in an image conversion apparatus according to FIG. 2.

Referring to FIG. 4, the image conversion apparatus 160 may calculate a contrast ratio CR for the first image signal RGB1 (S100). Here, the first image signal RGB1 may be of an RGB format. Therefore, the image conversion apparatus 160 may first convert the RGB format of the first image signal RGB1 into an YCbCr format. Specifically, the image conversion apparatus 160 may convert the RGB format of the first image signal RGB1 into a luminance signal according to the YCbCr format according to Equation 1 below.

$$Y=K_R \cdot R+K_G \cdot G+K_B \cdot B \quad \text{[Equation 1]}$$

Referring to Equation 1, R, G, and B may be red, green, and blue signals of the first image signal RGB1, in which Y may be a luminance according to the YCbCr format, and $K_R$, $K_G$, and $K_B$ may be coefficients for the red, green, and blue signals, respectively. Herein, the coefficients according to Equation 1 may satisfy the following Equation 2.

$$K_R+K_G+K_B=1 \quad \text{[Equation 2]}$$

According to the ITU-R BT.709 standard, the coefficient $K_R$ for the red signal R is 0.2126, the coefficient $K_G$ for the green signal G is 0.7152, and the coefficient $K_B$ for the blue signal B is 0.0722.

In addition, the image conversion apparatus 160 may convert the RGB format of the first image signal RGB1 into chroma signals according to the YCbCr format according to the following Equations 3 to 4.

$$C_b = \frac{1}{2} \cdot \frac{B-Y}{1-K_B} \quad \text{[Equation 3]}$$

Referring to Equation 3, a blue chroma signal Cb may be calculated using the blue signal B, the coefficient for the blue signal, and the luminance signal Y.

$$C_r = \frac{1}{2} \cdot \frac{R-Y}{1-K_R} \quad \text{[Equation 4]}$$

Referring to Equation 4, a red chroma signal Cr may be calculated using the red signal R, the coefficient for the red signal, and the luminance signal Y. Next, the image conversion apparatus 160 calculates a first maximum luminance value and a first minimum luminance value according to the YCbCr format from the first image signal RGB1, thereby calculating a contrast ratio for the first image signal RGB1. Specifically, the contrast ratio CR may be calculated according to the following Equation 5.

$$CR = \frac{Y_{max}}{Y_{min}} \quad \text{[Equation 5]}$$

Referring to Equation 5, the contrast ratio CR may be calculated by a ratio between a first maximum luminance value Ymax and a first minimum luminance value Ymin of the luminance signal according to the YCbCr format.

The image conversion apparatus 160 may convert the luminance of the first image signal in such a manner as to satisfy the reference maximum luminance value while maintaining the calculated contrast ratio (S110). Specifically, the image conversion apparatus 160 may calculate a reference minimum luminance value corresponding to the reference maximum luminance value on the basis of the contrast ratio.

For example, the reference minimum luminance value may be determined according to the following Equation 6.

$$Y'_{min} = \frac{Y'_{max}}{CR} \quad \text{[Equation 6]}$$

Referring to Equation 6, the reference minimum luminance value Y'min may be determined as a value obtained by dividing the reference maximum luminance value Y'max by the contrast ratio CR.

When the reference minimum luminance value is determined, the image conversion apparatus 160 calculates a conversion coefficient using a ratio between the reference minimum luminance value Y'min and the first minimum luminance value Ymin, to convert the luminance of the first image signal RGB1 according to the calculated conversion coefficient. For example, the conversion coefficient may be determined according to the following Equation 7.

$$W = \frac{Y_{min}}{Y'_{min}} \quad \text{[Equation 7]}$$

Referring to Equation 7, the conversion coefficient w may be determined as a value obtained by dividing the first minimum luminance value Ymin by the reference minimum luminance value Y'min. In addition, the image conversion apparatus 160 may convert the luminance of the first image signal RGB1 according to the following Equation 8.

$$Y'=w \cdot Y \quad \text{[Equation 8]}$$

Referring to Equation 8, a converted luminance Y' may be determined by multiplying the luminance Y of the first image signal RGB1 by the conversion coefficient w.

When the converted luminance Y' is determined, the image conversion apparatus 160 may generate a second image signal RGB2 of RGB format having the converted luminance Y' (S120). Herein, the red signal in the second image signal RGB2 of RGB format may be determined according to the following Equation 9.

$$R'=Y'+2 \cdot C_r \cdot (1-K_R) \quad \text{[Equation 9]}$$

Referring to Equation 9, the red signal R' of the second image signal RGB2 may be determined according to the converted luminance Y', the red chroma signal Cr (see Equation 4), and the coefficient $K_R$ for the red signal R.

The blue signal in the second image signal RGB2 of RGB format may be determined according to the following Equation 10.

$$B'=Y'+2 \cdot C_b \cdot (1-K_B) \quad \text{[Equation 10]}$$

Referring to Equation 10, the blue signal B' of the second image signal RGB2 may be determined depending on the converted luminance Y', the blue chroma signal Cb (see Equation 3), and the coefficient $K_B$ for the blue signal B.

The green signal of the second image signal RGB2 in RGB format may be determined as in the following Equation 11.

$$G' = \frac{Y' - K_R \cdot R' - K_B \cdot B'}{K_G} \quad \text{[Equation 11]}$$

Referring to Equation 11, the green signal G' of the second image signal RGB2 may be determined according to the converted luminance Y', the coefficients $K_R$, $K_G$, and $K_B$ for red signal R, green signal G, and blue signal B, and the red signal R' and blue signal B' according to Equation 9 and 10.

That is, the image conversion apparatus 160 converts the luminance of the first image signal RGB1, generates a second image signal RGB2 having the converted luminance, and displays an image on the display device 100 according to the second image signal RGB2. Herein, since the camera 200 captures an image displayed with a luminance according to characteristic information (for example, aperture value) of the camera 200, it is possible to address a problem in which unnecessary shadows are displayed in the captured image or visibility is degraded.

Meanwhile, the first image signal RGB1 and the second image signal RGB2 may have the same color depth. For example, when the color depth of the first image signal RGB1 is 8 bits, the color depth of the second image signal may be also 8 bits. That is, when generating the second image signal RGB2 by converting the luminance of the first image signal RGB1, the image conversion apparatus 160 may maintain the color depth unchanged.

Therefore, the color depth and contrast ratio of the first image signal RGB1 are maintained to be the same in the second image signal RGB2, so that even when the display device 100 displays an image according to the second image signal RGB2 instead of the first image signal RGB1, it is possible to prevent the heterogeneity that a viewer can feel.

Figure 5:
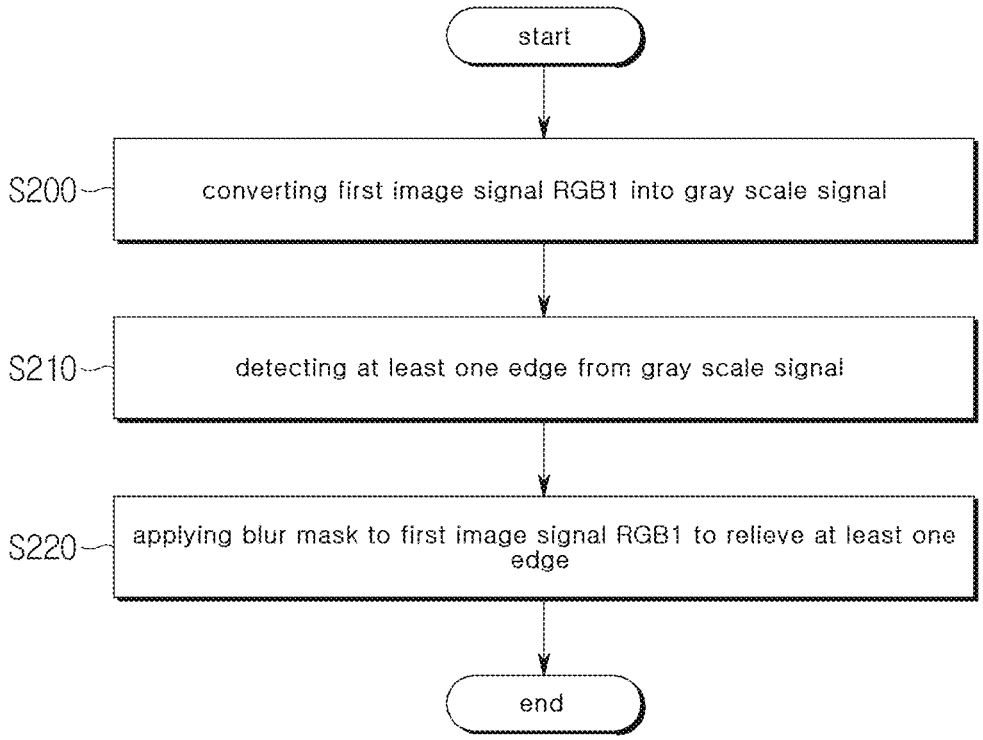
FIG. 5 is a flowchart illustrating a process of relieving an edge of a first image signal in an image conversion apparatus according to FIG. 2 in accordance with an embodiment of the present disclosure.
Figure 6:
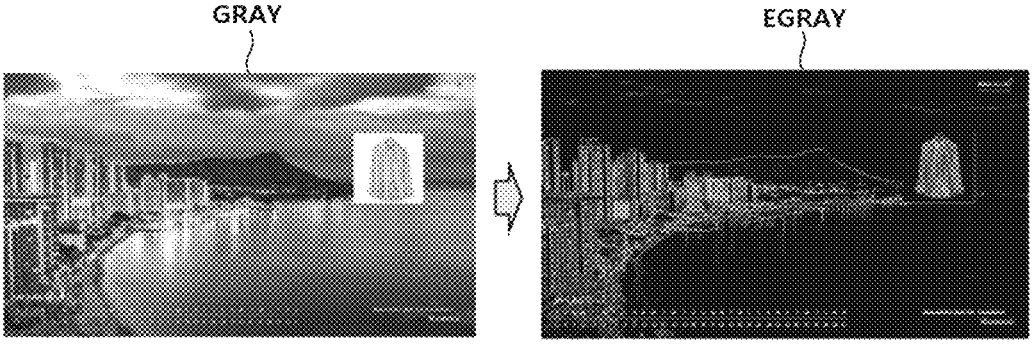
FIG. 6 is an exemplary diagram illustrating image conversion for detecting an edge of a first image signal in a process according to FIG. 5 according to an embodiment of the present disclosure.
Figure 7:
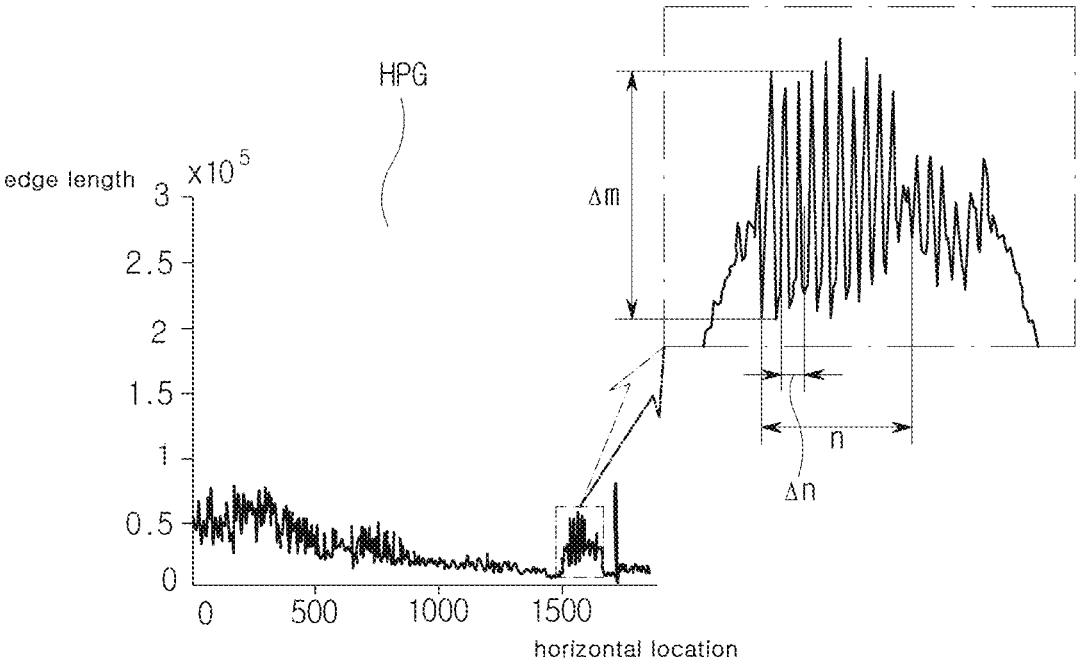
FIG. 7 is a conceptual diagram illustrating a method of detecting an edge of a second image signal in a process according to FIG. 5 according to an embodiment of the present disclosure.

FIG. 5 is a flowchart illustrating a process of relieving an edge of a first image signal in the image conversion apparatus according to FIG. 2; FIG. 6 is an exemplary diagram illustrating image conversion for detecting an edge of a first image signal in a process according to FIG. 5; and FIG. 7 is a conceptual diagram illustrating a method of detecting an edge of a second image signal in a process according to FIG. 5.

As described above, in the case that edges are repeatedly present in a first image signal RGB1 at a certain interval, moiré artifacts may be recognized when capturing an image displayed by the first image signal RGB1.

To solve this problem, the image conversion apparatus 160 according to FIG. 2 detects at least one edge from the first image signal RGB1 and applies a blur mask to the first image signal RGB1, thereby relieving the at least one edge.

Referring to FIG. 5, since a color component of the first image signal RGB1 does not affect the edge detection, the first image signal RGB1 may be converted into a gray scale signal GRAY (S200).

Next, the image conversion apparatus 160 may detect at least one edge from the gray scale signal GRAY (S210). Specifically, the image conversion apparatus 160 may generate boundary data composed of edges for the first image signal RGB1 by applying a Sobel mask to the gray scale signal GRAY.

Referring to FIG. 6, the boundary data EGRAY generated by applying the Sobel mask to the gray scale signal GRAY may be checked, in which such boundary data EGRAY may be composed of edges of the first image signal RGB1.

Herein, the image conversion apparatus 160 projects the boundary data EGRAY in a horizontal or vertical direction, and a blur mask may be applied to the first image signal RGB1 in consideration of the size of the edge included in the projected boundary data EGRAY and the distance between the edges.

Specifically, referring to FIG. 7 it is possible to check a graph HPG showing the length of an edge according to the horizontal location of the boundary data EGRAY, by projecting an output data EGRAY in a horizontal direction.

As described above, in the case that edges having a length equal to or greater than a predetermined length Δm are repeatedly present within a predetermined horizontal distance n when projecting the boundary data EGRAY in the horizontal direction, moiré artifacts may be recognized when capturing the image according to the first image signal RGB1. Therefore, in this case, a blur mask may be applied to the first image signal RGB1.

Similarly, in the case that edges having a length equal to or greater than a predetermined length are repeatedly present within a predetermined vertical distance when projecting the boundary data EGRAY in the vertical direction, a blur mask may be applied to the first image signal RGB1.

According to embodiments, the predetermined length Δm may decrease as characteristic information (e.g., aperture value) of the camera 200 increases. For example, a predetermined length for a first aperture value may be greater than a predetermined length for a second aperture value greater than the first aperture value. However, embodiments of the present disclosure are not limited thereto.

According to embodiments, in the case that edges having a length equal to or longer than a predetermined length Δm are repeatedly present within a predetermined horizontal distance n when projecting the boundary data EGRAY in the horizontal direction, a blur mask may be applied to the first image signal RGB1 when the distance between the edges is less than or equal to a predetermined interval Δn.

According to embodiments, the predetermined interval Δn may increase as the characteristic information (e.g., aperture value) of the camera 200 increases. For example, a predetermined interval for the first aperture value may be smaller than a predetermined interval for the second aperture value greater than the first aperture value. However, embodiments of the present disclosure are not limited thereto.

When capturing an image according to the first image signal RGB1, moiré artifacts may be recognized. Therefore, in this case, a blur mask may be applied to the first image signal (RGB1).

That is, the image conversion apparatus 160 applies a blur mask to the first image signal RGB1 to relieve at least one edge detected in the gray scale signal GRAY and outputs the same to the controller 120 (S220), thereby preventing a moiré artifact from being recognized.

The Sobel mask or blur mask according to an embodiment of the present disclosure is not limited to a special form. Since the skilled person may easily apply the Sobel mask or the blur mask in various ways, a detailed description is omitted.

Meanwhile, steps S200 to S220 according to FIG. 5 are described for the first image signal RGB1, but are not limited thereto. For example, the second image signal RGB2 generated according to FIG. 4 is converted into a gray scale signal, an edge is detected from the converted gray scale signal, and then a blur mask is applied to the same. Similarly, steps S100 to S120 according to FIG. 4 should be performed on the first image signal RGB1 to which the blur mask is applied according to step S220.

The drawings referenced so far and the detailed description of the described invention are merely illustrative of the present disclosure, which is used for the purpose of describing the present disclosure only and is used to limit the scope of the present disclosure as defined in the claims or the claims. Therefore, it will be appreciated that various modifications and other equivalent embodiments are possible to those skilled in the art. Therefore, the true technical protection scope of the present disclosure should be defined by the technical spirit of the appended claims.

What is claimed is:

1. A display device, comprising:

an image conversion apparatus receiving a first image signal from outside the display device and outputting a second image signal by converting a luminance of the received first image signal;

a controller generating image data based on the second image signal;

a source driver outputting data signals based on the image data;

a display panel including a plurality of sub-pixels that emit light based on the data signals; and a memory that stores a reference maximum luminance value, wherein the image conversion apparatus generates the second image signal by converting the luminance of the first image signal in such a manner to satisfy the reference maximum luminance value, wherein the image conversion apparatus calculates a contrast ratio using a first maximum luminance value and a first minimum luminance value, and calculates a conversion coefficient based on the contrast ratio, to convert the luminance of the first image signal according to the conversion coefficient.

2. The display device of claim 1, wherein the reference maximum luminance value is determined according to characteristic information of a camera capturing an image displayed on the display device.

3. The display device of claim 1, wherein the image conversion apparatus calculates a reference minimum luminance value corresponding to the reference maximum luminance value based on the contrast ratio, and calculates the conversion coefficient using the reference minimum luminance value and the first minimum luminance value.

4. The display device of claim 1, wherein the first image signal and the second image signal have a same color depth.

5. A display device, comprising:

an image conversion apparatus receiving a first image signal from outside the display device and outputting a second image signal by converting a luminance of the received first image signal;

a controller generating image data based on the second image signal;

a source driver outputting data signals based on the image data;

a display panel including a plurality of sub-pixels that emit light based on the data signals; and a memory that stores a reference maximum luminance value, wherein the image conversion apparatus generates the second image signal by converting the luminance of the first image signal in such a manner to satisfy the reference maximum luminance value, wherein the image conversion apparatus detects at least one edge from the first image signal and applies a blur mask to the first image signal to relieve the at least one edge, wherein the image conversion apparatus converts the first image signal to a gray scale signal and applies a Sobel mask to the gray scale signal to generate boundary data composed of edges for the first image signal, wherein the image conversion apparatus detects the at least one edge by projecting the boundary data in a horizontal or vertical direction, and wherein the image conversion apparatus applies the blur mask to the first image signal when edges having a length equal to or greater than a predetermined length in the boundary data are repeatedly present within a predetermined distance.

6. An image conversion method performed in an image conversion apparatus, the method comprising:

calculating a contrast ratio for a first image signal received from outside the image conversion apparatus;

converting a luminance of the first image signal in such a manner as to satisfy a reference maximum luminance value while maintaining the contrast ratio; and generating and outputting a second image signal having the converted luminance, wherein the reference maximum luminance value is determined according to characteristic information of a camera capturing an image displayed according to the second image signal.

7. The method of claim 6, wherein the calculating of the contrast ratio includes:

converting the first image signal into a YCbCr format, and calculating the contrast ratio using a first maximum luminance value and a first minimum luminance value according to the converted YcbCr format.

8. The method of claim 7, wherein the converting of the luminance of the first image signal includes:

calculating a conversion coefficient based on the contrast ratio and converting the luminance of the first image signal according to the conversion coefficient.

9. The method of claim 8, wherein the converting of the luminance of the first image signal includes:

calculating a reference minimum luminance value corresponding to the reference maximum luminance value based on the contrast ratio; and calculating the conversion coefficient using the reference minimum luminance value and the first minimum luminance value.

10. The method of claim 6, wherein the first image signal and the second image signal have a same color depth.

11. The method of claim 6, further comprising:

detecting at least one edge from the first image signal; and relieving the at least one edge by applying a blur mask to the first image signal.

12. The method of claim 11, wherein the detecting of at least one edge includes:

converting the first image signal into a gray scale signal;

generating boundary data composed of edges for the first image signal by applying a Sobel mask to the gray scale signal; and detecting the at least one edge by projecting the boundary data in a horizontal or vertical direction.

13. The method of claim 12, wherein the relieving of the at least one edge includes:

applying the blur mask to the first image signal, when edges having a length equal to or longer than a predetermined length in the boundary data are repeatedly present within a predetermined distance.

14. A non-transitory computer readable storage medium comprising a computer program for executing the image conversion method according to claim 6 when executed on a computer.

* * * * *